United States Patent [19]

Clavet

[11] Patent Number: 4,808,140

[45] Date of Patent: Feb. 28, 1989

[54] TOY BUILDING BLOCK

[75] Inventor: Alain Clavet, Laval, Canada

[73] Assignee: Idee International R & D Inc., Montreal, Canada

[21] Appl. No.: 96,969

[22] Filed: Sep. 15, 1987

[51] Int. Cl.[4] ..... A63H 33/08; A63H 33/12

[52] U.S. Cl. ..... 446/127; 446/122; 446/128

[58] Field of Search ..... 446/127, 128, 120, 121, 446/122, 123

[56] References Cited

U.S. PATENT DOCUMENTS

| | | | |
|---|---|---|---|
| 3,391,824 | 7/1968 | Wiseman | 446/125 X |
| 3,456,413 | 7/1969 | Fischer | 441/125 X |
| 3,558,138 | 1/1971 | Lemelson | 446/127 X |
| 3,791,090 | 2/1974 | Kniefel | 446/127 X |
| 4,035,947 | 7/1977 | Burge | 446/127 |
| 4,345,762 | 8/1982 | Lebelson | 446/127 X |
| 4,423,465 | 12/1983 | Teng-Ching et al. | 446/127 X |

FOREIGN PATENT DOCUMENTS

| | | | |
|---|---|---|---|
| 1808208 | 9/1970 | Fed. Rep. of Germany | 446/127 |
| 2231294 | 1/1974 | Fed. Rep. of Germany | 446/120 |
| 588608 | 7/1974 | Switzerland | 446/127 |
| 379836 | 9/1932 | United Kingdom | 446/128 |

*Primary Examiner*—Robert A. Hafer
*Assistant Examiner*—D. Neal Muir
*Attorney, Agent, or Firm*—Seaby, Proulx & Palmer

[57] ABSTRACT

A toy building block includes a rectangular parallelpipedic body with a pair of dovetail-shaped slots extending transversely across the center of four adjacent sides thereof, and a lug extending outwardly from the center of the slots on two of the sides, the portion of the lug projecting outwardly beyond the plane of the side of the block also having a dovetail cross section for sliding engagement with the slots, and the central portion of each lug being bifurcated, the sides of the central portion flexing inwardly to permit insertion of the lug into a slot and bearing against the sides of the slot to releasably lock the lug in the slot.

2 Claims, 4 Drawing Sheets

TOY BUILDING BLOCK

BACKGROUND OF THE INVENTION

1. FIELD OF THE INVENTION

This invention relates to a construction toy, and in particular to a toy building block.

2. DISCUSSION OF THE PRIOR ART

There are presently available a large number of construction or block-type toys. Since the advent of modern plastics many block-type toys have appeared in the marketplace. Perhaps, the most popular toy of this type is the product available under trade mark Lego. While such toys have achieved tremendous success, there is always room for change, i.e. for different toys which capture the interest and imagination of the ultimate user.

With the foregoing in mind, the object of the present invention is to provide a relatively simple, easy to assemble, interesting toy building block, which can be used to construct a large variety of different structures such as buildings and vehicles.

GENERAL DESCRIPTION OF THE INVENTION

Accordingly, the present invention relates to a toy building block comprising body means defining a geometric figure having at least one straight, planar side wall; slot means in at least one said planar side wall; lug means extending outwardly from at least one said planar side wall for sliding engagement with said slot means on a similar block; and resilient lock means on said lug means for engaging at least one side of said slot means for releasably locking the blocks together.

BRIEF DESCRIPTION OF DRAWINGS

The invention will now be described in greater detail with reference to the accompanying drawings, which illustrate a preferred embodiment of the invention, and wherein.

DESCRIPTION OF PREFERRED EMBODIMENTS

Figure 3:
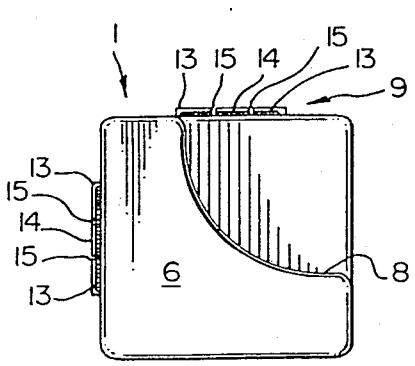
FIG. 3 is an end view of the block of FIGS. 1 and 2.
Figure 2:
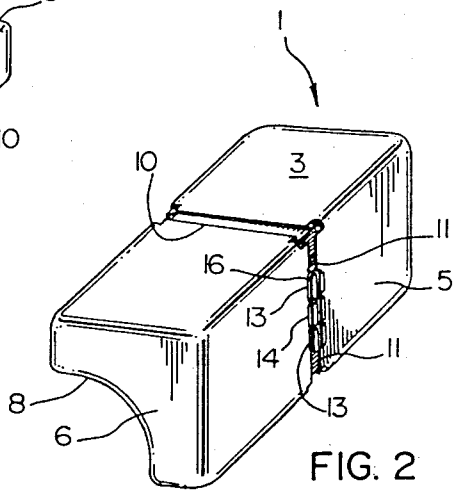
FIG. 2 is a perspective view of the block of FIG. 1 from the other end and a second side at 180° to the side of FIG. 1.
Figure 1:
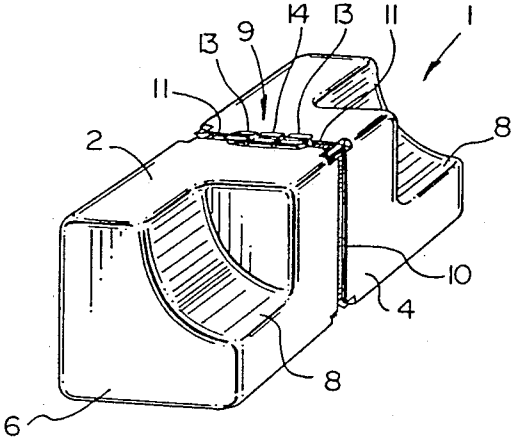
FIG. 1 is a perspective view from one end and one side of a toy building block in accordance with the invention.
Figure 5:
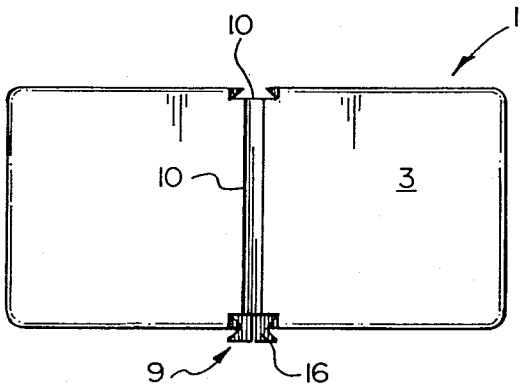
FIG. 5 is a bottom view of the block of FIGS. 1 to 4.
Figure 4:
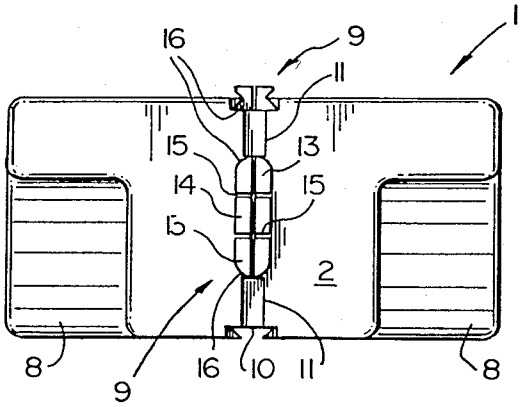
FIG. 4 is a plan view of the block of FIGS. 1 to 3.
Figure 6:
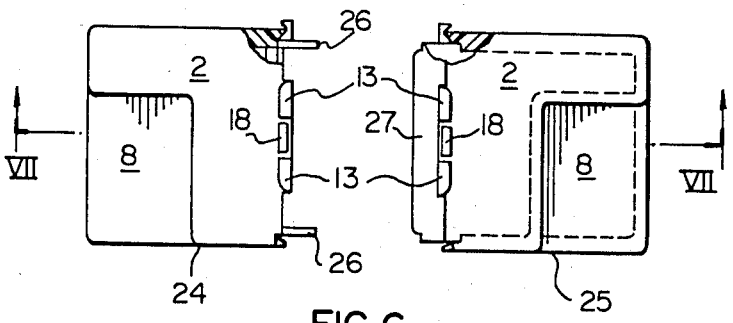
FIG. 6 is a schematic, partly sectioned exploded view of two casings used to form the block of FIGS. 1 to 5.

It will be appreciated that the sides of the block have been designated as the top, bottom, front, rear and ends merely to facilitate the describing of the block.

With reference to FIGS. 1 to 5, the block of the present invention includes a rectangular parallelepipedic body generally indicated at 1, i.e. a body each of the sides of which is rectangular, and in which all of the corners define right angles. The body is defined by a top wall 2, a bottom wall 3, a front wall 4, a rear wall 5, and end walls 6. A deep groove 8 in the shape of a segment of a cylinder is provided at each end of the body, the ends of the groove intersecting the top and front walls 2 and 4, respectively of the body. The edges and corners of the body 1 are rounded to reduce the likelihood of injury.

Blocks are connected to similar blocks by means of lugs generally indicated at 9, and slots 10 and 11. The lugs 9 are defined by elongated, transversely extending projections in the centre of the top and rear walls 2 and 5, respectively of the body 1. Each lug 9 has a dovetail cross-sectional configuration for sliding into a similarly shaped slot 10 or 11. The slots 10 extend transversely of the bottom and front walls 3 and 4, respectively at the centre thereof. The slots 10 extend completely across the body so that one end of each slot intersects one end of the other slot 10. The other end of each slot 10 intersects the outer end of the shorter slots 11 in the top and rear walls 2 and 5. The slots 11 extend between the ends of the lugs 9 and the outer edges of the walls 2 and 5.

Figure 7:
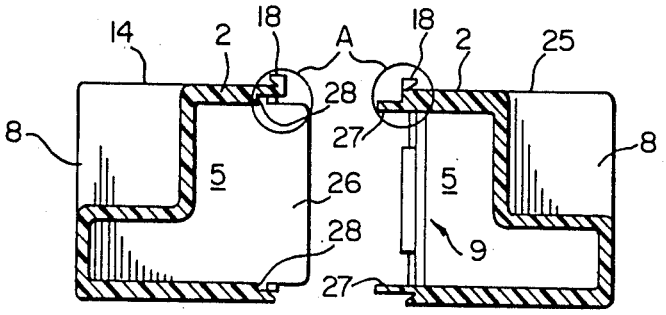
FIG. 7 is a cross section taken generally along line VII—VII of FIG. 6.
Figure 8:
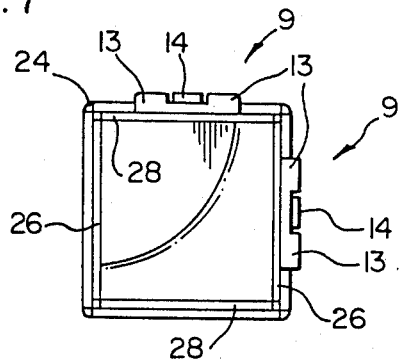
FIG. 8 is an inner end view of one casing used in the production of the block of FIGS. 1 to 7.
Figure 9:
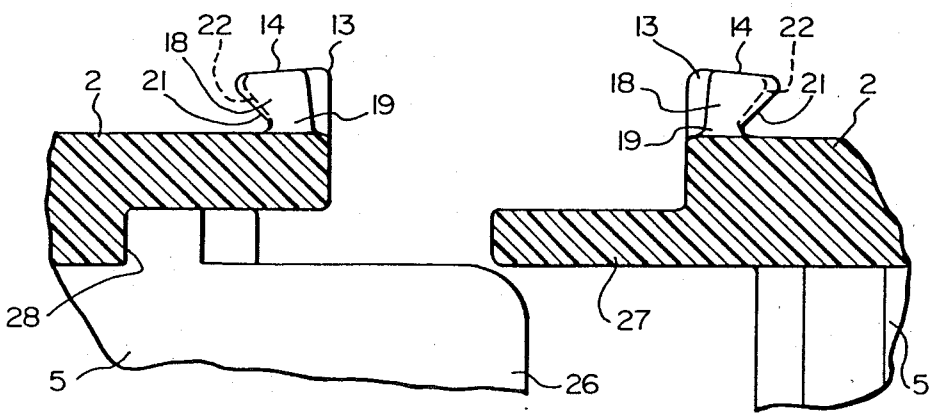
FIG. 9 is an enlarged view of areas A of FIG. 7 illustrating the assembly of the casings to form a block.

Each lug 9 is defined by three coaxial, longitudinally aligned, bifurcated sections, including a pair of similar end sections 13 and a central section 14, with gaps 15 between each section. The two end sections 13 have the same length and width, and convex outer ends 16 to facilitate insertion of the lug 9 into a slot 10 or 11. The central lug section 14 is defined by a pair of laterally spaced apart projections 18 (FIGS. 7 and 8) of generally triangular cross section. Thus, the projections 18 are connected to the body by a thin web 19 of plastic, so that the projections can move, i.e. flex laterally in the direction of the longitudinal axis of the body 1. The angle between the outer, inclined side 21 of each projection 18 and the adjacent top or rear body wall 2 or 5 is less than the angle between the outer, inclined sides 22 of the end sections 13. Moreover, the overall width of the top of the central section 14 is slightly greater than the width of the top of the end sections 13. Thus, when the lug is inserted into a slot 10 or 11, the projections flex inwardly so that the lug 9 can be fully inserted into the slot 10 or 11. When in the slot 10 or 11, the outer sides 21 of the projection 18 are parallel to the sides of the slot, so that there is a large surface area of the projections 18 and the sides of the slot in contact. If the angles in question were not different, e.g. if the angles before insertion were the same for the end sections 13 and the central section 14 of the lug 9, when the projections flexed or bent upon entering the slot 10 or 11, only a small area at the bottom of each projection 18 would engage the side of the slot 10 or 11. It would take a relatively short time for the engaging area to wear, adversely affecting the friction fit between the parts. The difference between the width of the central section 14 and that of each end section 13 of the lug 9 will vary depending upon the type of material used to produce the block. It is necessary to experiment with different lug dimensions and clearances to determine the best values for each material.

As is readily apparent, the end sections 13 of the lug 9 are bifurcated because the body of the block is produced using two hollow, generally cubical casings 24 and 25. The casings 24 and 25 include flanges 26 and 27 extending outwardly from the open ends thereof. The flanges 26 and 27 are staggered, i.e. the flanges 26 on one end casing 24 are at right angles to the flanges 27 on the other casing 25. The flanges 26 or 27 of one casing 24 or 25 are inserted into the other casing coming to rest against shoulders 28. Glue (not shown) is provided in the area 30 where the casings 24 and 25 overlap to secure the casings together for defining the body 1. A portion of the outer surface of each of the flanges 26 and 27 remains exposed, defining the bottom of the slots 10 and 11.

It will be appreciated that in its simplest form the block of the present invention is a rectangular parallelepiped with at least one slot extending transversely of at least one side, and at least one lug extending outwardly from at least one side. The slot could be near one edge of one side of the block and the lug at the other edge of the same side. The provision of an arcuate groove at one end permits the construction of seats using two interconnected blocks, the combined grooves forming a semi-disc shaped recess. Such recess also defines a wheel well for a toy vehicle constructed using the blocks. When constructing a toy vehicle or building, windows, grills, wheel axles and the like can be attached to the blocks by providing a dovetail-shaped rod integral with or connected to the element to be attached to the block.

I claim:

1. A toy building block comprising rectangular, parallelepipedic body means including four contiguous, planar, rectangular sides and a pair of planar ends; first slot means extending transversely of across a central portion of two adjacent first sides between the edges thereof; lug means extending outwardly from and transversely across a central portion of the remaining two adjacent second sides of said body means for sliding engagement with a said first slot means on a similar block, said lug means having a dovetail cross section, the lug means being shorter than the width of said second sides, and including a pair of similar bifurcated end sections, a bifurcated center section, and transversely extending gaps between said end and center sections, whereby said lug means are flexible to facilitate insertion of said lug means into said first slot means of a similar block, and to cause said lug means to bear against the sides of said first slot means for releasably holding the lug means in said first said slot means of a similar block; and a pair of longitudinally aligned, arcuate grooves in the ends of said body means, each said groove defining a segment of a cylinder, the curved side of which intersects adjacent side walls of the body means, whereby two such grooves on the block and a similar adjacent block can define a semi-disc shaped recess for receiving a wheel.

2. A toy building block according to claim 1, including second slot means in each said second side of said body means extending from the ends of said lug means to the edges of said second sides.

* * * * *